US010293839B2

(12) United States Patent
Coseglia

(10) Patent No.: US 10,293,839 B2
(45) Date of Patent: May 21, 2019

(54) RAILWAY CAR TRUCK WITH FRICTION DAMPING

(71) Applicant: Amsted Rail Company, Inc., Chicago, IL (US)

(72) Inventor: John Coseglia, Edwardsville, IL (US)

(73) Assignee: AMSTED RAIL COMPANY, INC., Chicago, IL (US)

( * ) Notice: Subject to any disclaimer, the term of this patent is extended or adjusted under 35 U.S.C. 154(b) by 0 days.

(21) Appl. No.: 14/958,210

(22) Filed: Dec. 3, 2015

(65) Prior Publication Data

US 2017/0158208 A1 Jun. 8, 2017

(51) Int. Cl.
*B61F 5/04* (2006.01)
*B61F 5/52* (2006.01)

(52) U.S. Cl.
CPC . *B61F 5/04* (2013.01); *B61F 5/52* (2013.01)

(58) Field of Classification Search
CPC ..... B16F 5/02; B16F 5/04; B61F 5/52; B61F 5/02; B61F 5/04
USPC ..... 105/212, 182.1, 198.2, 198.5
See application file for complete search history.

(56) References Cited

U.S. PATENT DOCUMENTS

| | | | | |
|---|---|---|---|---|
| 1,976,937 A | | 10/1934 | Haseltine | |
| 2,159,138 A | | 5/1939 | Duryea | |
| 2,272,426 A | | 2/1942 | Nystrom et al. | |
| 3,577,931 A | | 5/1971 | Shafer | |
| 3,601,063 A | | 8/1971 | Dean | |
| 3,862,606 A | * | 1/1975 | Scales | B61F 3/02 105/167 |
| 4,067,261 A | | 1/1978 | Scheffel | |
| 4,455,946 A | * | 6/1984 | List | B61F 3/02 105/168 |
| 4,655,143 A | * | 4/1987 | List | B61F 3/02 105/168 |
| 4,817,536 A | * | 4/1989 | Cripe | B60T 13/406 105/182.1 |
| 6,895,866 B2 | * | 5/2005 | Forbes | B61D 3/18 105/197.05 |

(Continued)

FOREIGN PATENT DOCUMENTS

| | | | | |
|---|---|---|---|---|
| CN | 2411946 Y | * | 12/2000 | B61F 5/04 |
| CN | 2411946 Y | | 12/2000 | |

(Continued)

OTHER PUBLICATIONS

Australian Patent Office, Office Action dated Aug. 23, 2017, from corresponding Australian Patent Application No. 2016247178, 7 pages.

(Continued)

*Primary Examiner* — Robert J McCarry, Jr.
*Assistant Examiner* — Scott A Browne
(74) *Attorney, Agent, or Firm* — Amsted Industries Incorporated

(57) ABSTRACT

A device is provided for addition to a three piece railway freight truck to prevent vertical over travel of the bolster and absorb inertia energy of the bolster before it impacts the side frame or brake equipment.

Two variations of this device have a gap which prevents the device from being engaged under normal operating conditions. The device utilizes an energy absorbing elastomer material mounted between the top of the bolster end and the bottom of the side frame top center compression member.

6 Claims, 7 Drawing Sheets

(56) References Cited

U.S. PATENT DOCUMENTS 7,174,837 B2 * 2/2007 Berg ..... B61F 5/122
105/197.05

FOREIGN PATENT DOCUMENTS

| | | | |
|---|---|---|---|
| CN | 100404342 | C | 7/2008 |
| CN | 10133285 | A | 12/2008 |

OTHER PUBLICATIONS

Office Action and Search Report in corresponding Chinese Application No. 201611048898.5, dated May 29, 2018, 14 pages.
Office Action and Search Report in corresponding Chinese Application No. 201611048898.5, dated Feb. 3, 2019, 13 pages.
Office Action in corresponding Canadian Application No. 2,945,709, dated Nov. 16, 2017, 4 pages.

* cited by examiner

RAILWAY CAR TRUCK WITH FRICTION DAMPING

BACKGROUND OF THE INVENTION

The traditional three piece railway freight car truck consists of one bolster and two side frames. The side frames are supported at their ends by the wheelsets. The bolster which carries the car body extends centrally through the side frames. The bolster is supported on suspension springs with damping friction shoes located in the side frames that support the bolster. The suspension contains load springs that support the bolster and control springs that support the friction shoes. The friction shoes include angled surfaces that bear against the bolster in pockets that have mating angled surfaces. The result of the spring force acting on friction shoe against the angled support of the bolster is a wedge force acting on the side frame. Damping is the result of the wedge force on the friction shoe flat surface sliding against and along the flat surface of the side frame. The resulting wedge force and friction between the friction shoe flat surface and the side frame flat surface creates sliding force resistant to movement. There are generally two types of friction damping systems in use constant and variable. In the constant damped system, the springs creating the force against the wedge are not load bearing and friction force is the same regardless of load on the truck centerplate so the shoe sliding force resistance is constant. In the variable damped system, the springs applying the force to the wedges are also load bearing springs and apply more force to the wedge when under load than when the freight car is empty so the shoe sliding force resistance increases as the springs are compressed.

In some variable damped systems the wedge springs have little or no compression and there is insufficient shoe sliding force resistance when the freight car is empty. Under these conditions, vertical track irregularities cause the springs to be compressed and store energy and when the energy is released, without sufficient sliding force resistance, the energy and inertia cause the bolster and freight car body to travel vertically through the neutral point and the bolster may rise up off the load springs. Sometimes excessive vertical impact can occur between truck components possibly damaging them; further, springs can become dislocated out of their seat locations.

In addition to insufficient friction damping, there are other situations such as extreme vertical track irregularities or loading and unloading operations, which can cause the bolster to move vertically by an excessive amount and thereby impacting the side frame, or brake equipment, or causing displacement of springs.

The present invention relates to limiting the vertical travel of the bolster and absorbing the energy before damage can occur to truck components.

SUMMARY OF THE INVENTION

Vertical irregularities in the railroad track cause the load springs of the truck to store and release energy, and some three piece railway freight car truck suspensions do not have sufficient resistance to vertical travel when the freight car is empty. This can lead to component damage in the truck, brake equipment, and can transmit large vertical accelerations to the car body. In some cases the springs can get dislocated from their seats.

The present invention relates to limiting the vertical travel of the bolster relative to the side frame and absorbing the energy before impact can occur between the bolster and side frame or brake equipment.

DETAILED DESCRIPTION OF THE INVENTION

Figure 1:
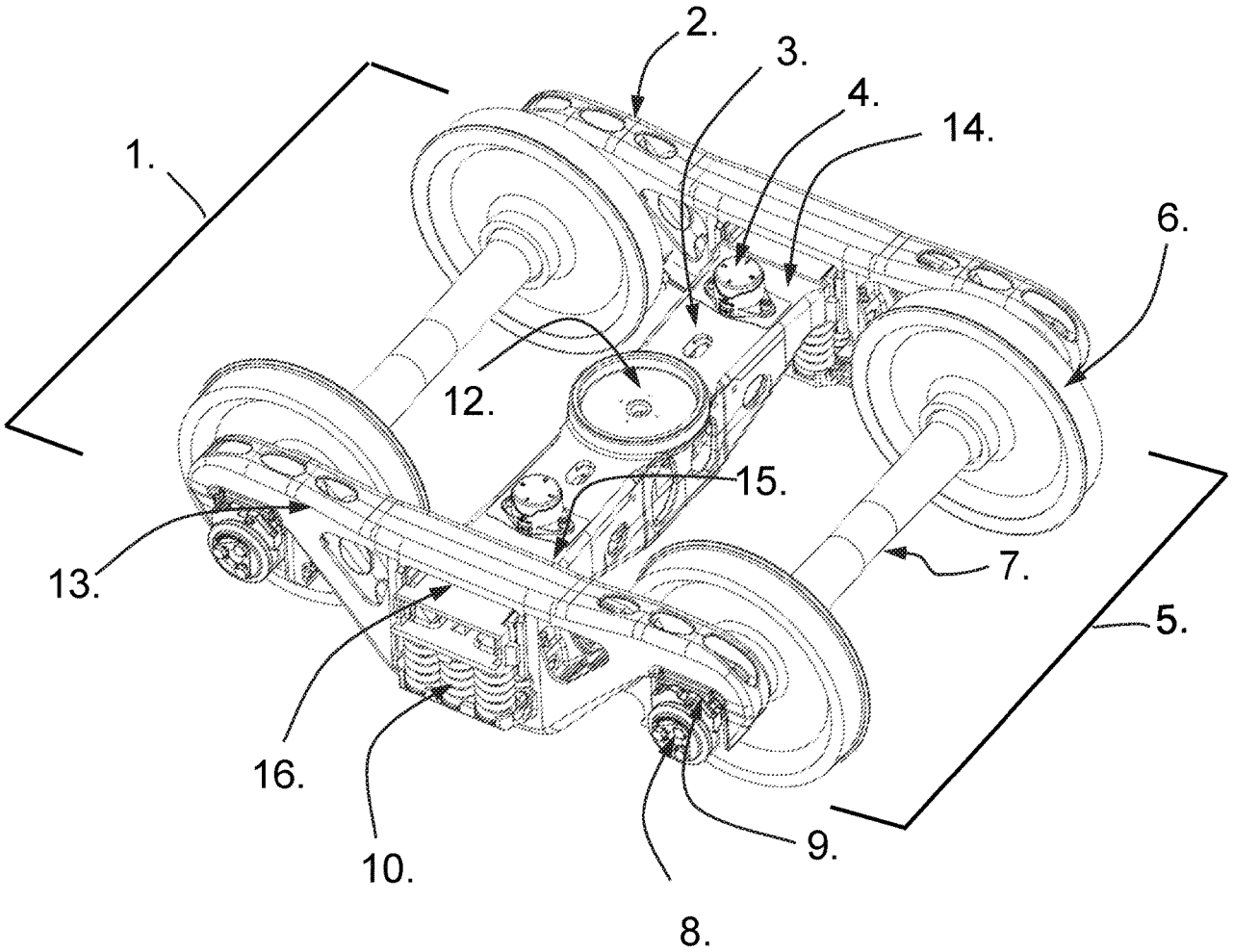
FIG. 1 is a perspective view of a three piece railway freight truck assembly applicable to all embodiments of the present invention.
Figure 2:
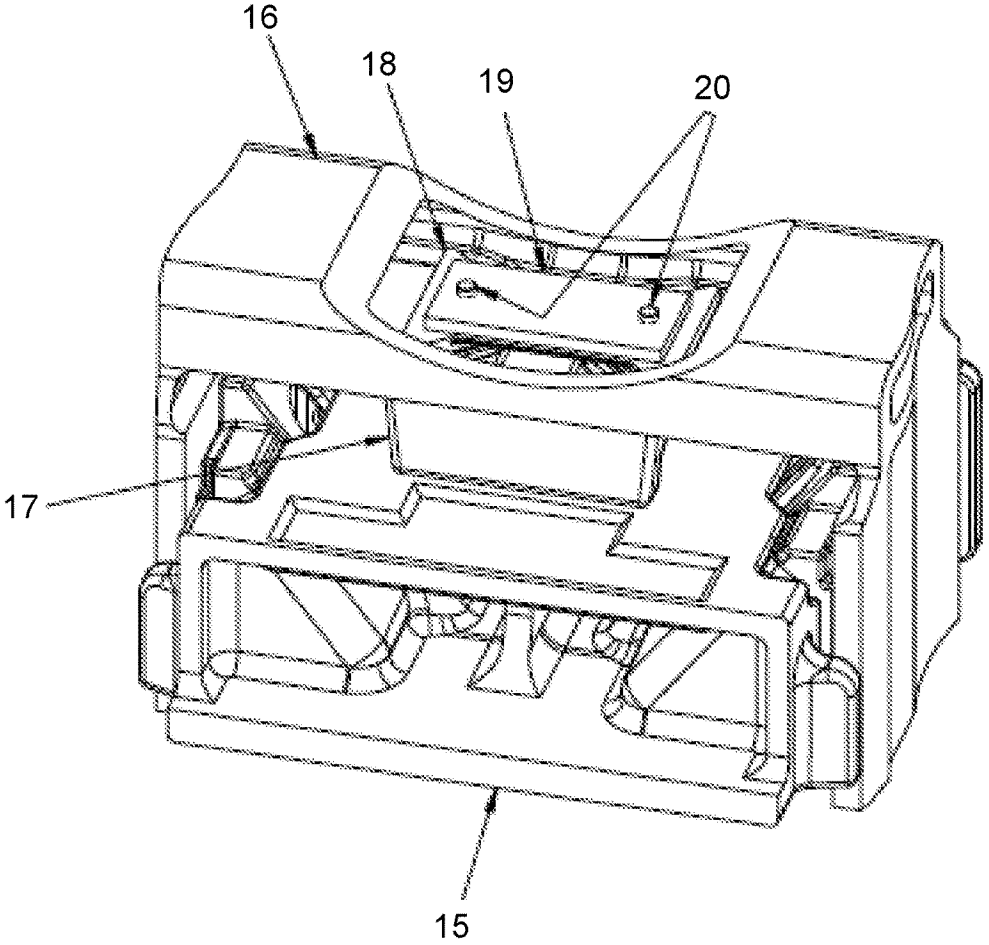
FIG. 2 is a partial detailed cut away view of a traditional three piece railway freight truck with a first embodiment of the present invention.
Figure 3:
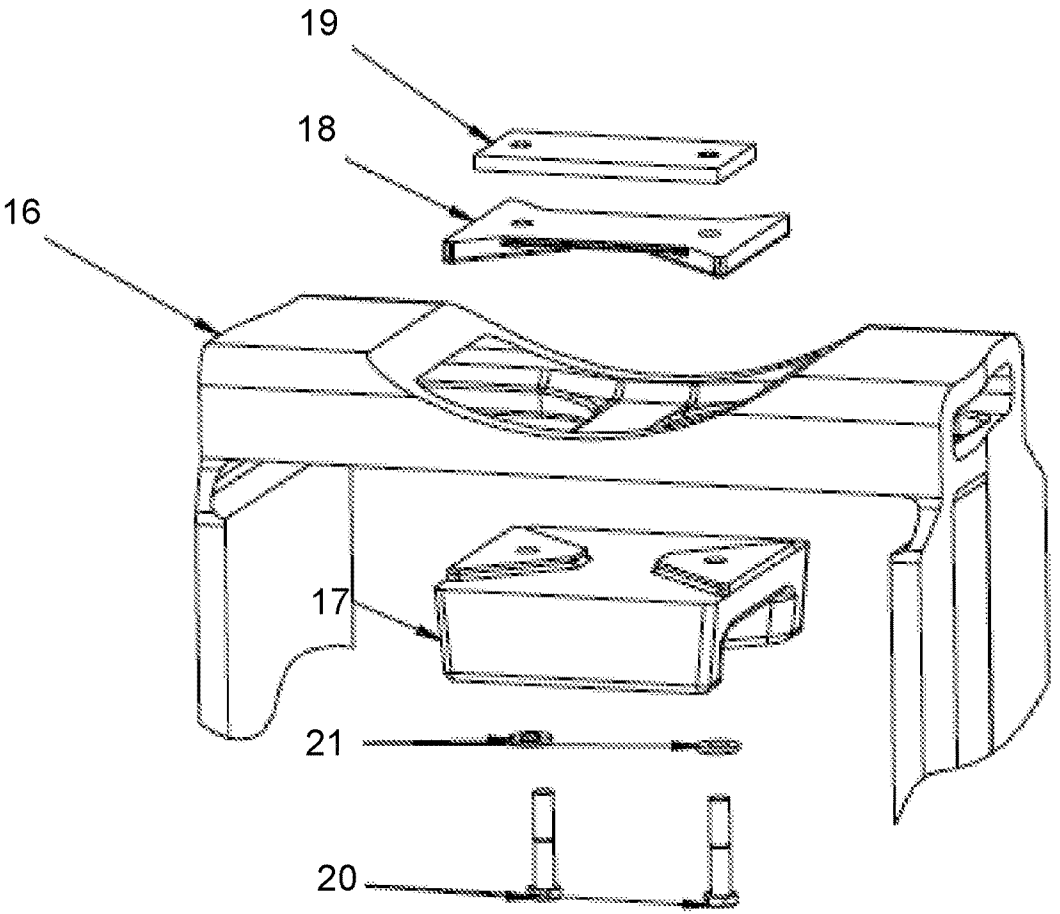
FIG. 3 is an exploded view of a first embodiment of the present invention with a partial detailed cut away view of a side frame.
Figure 4:
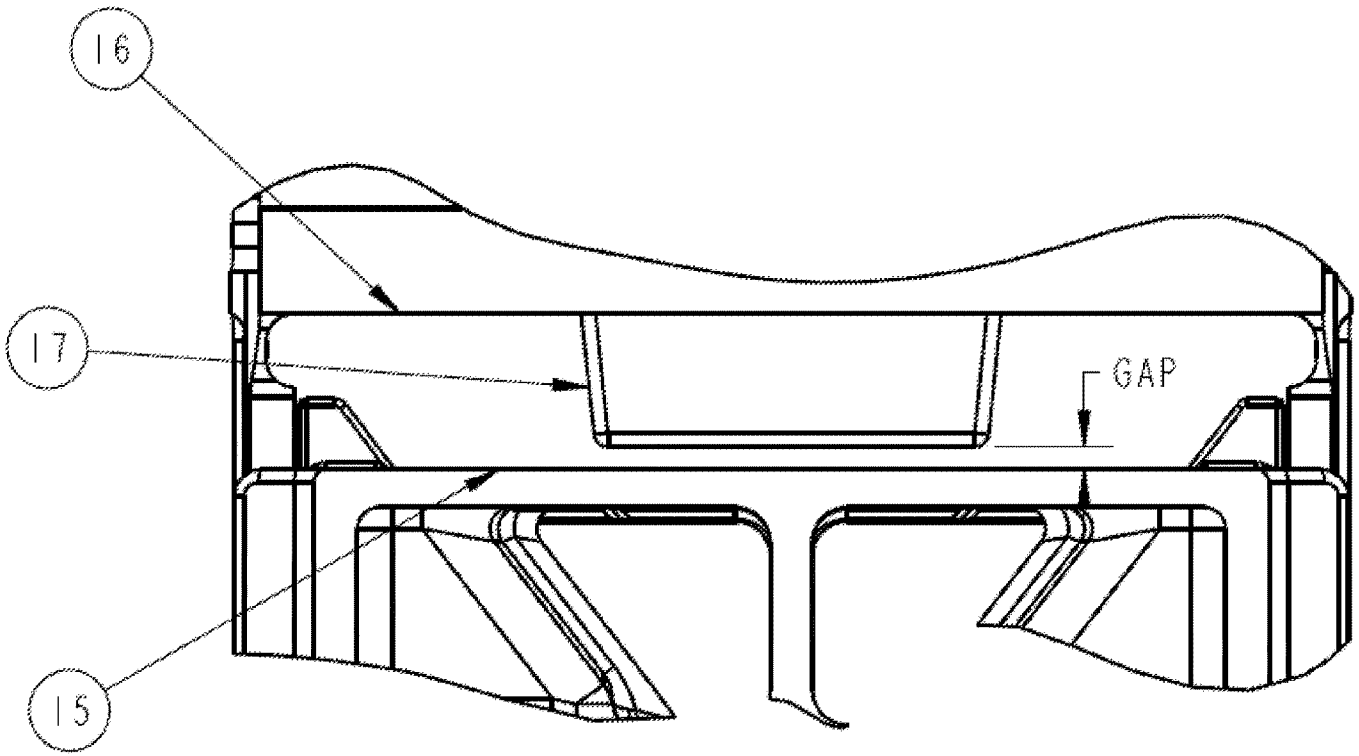
FIG. 4 is a partial assembly view of the gap between a first embodiment of the present invention and the railway truck bolster end.
Figure 5:
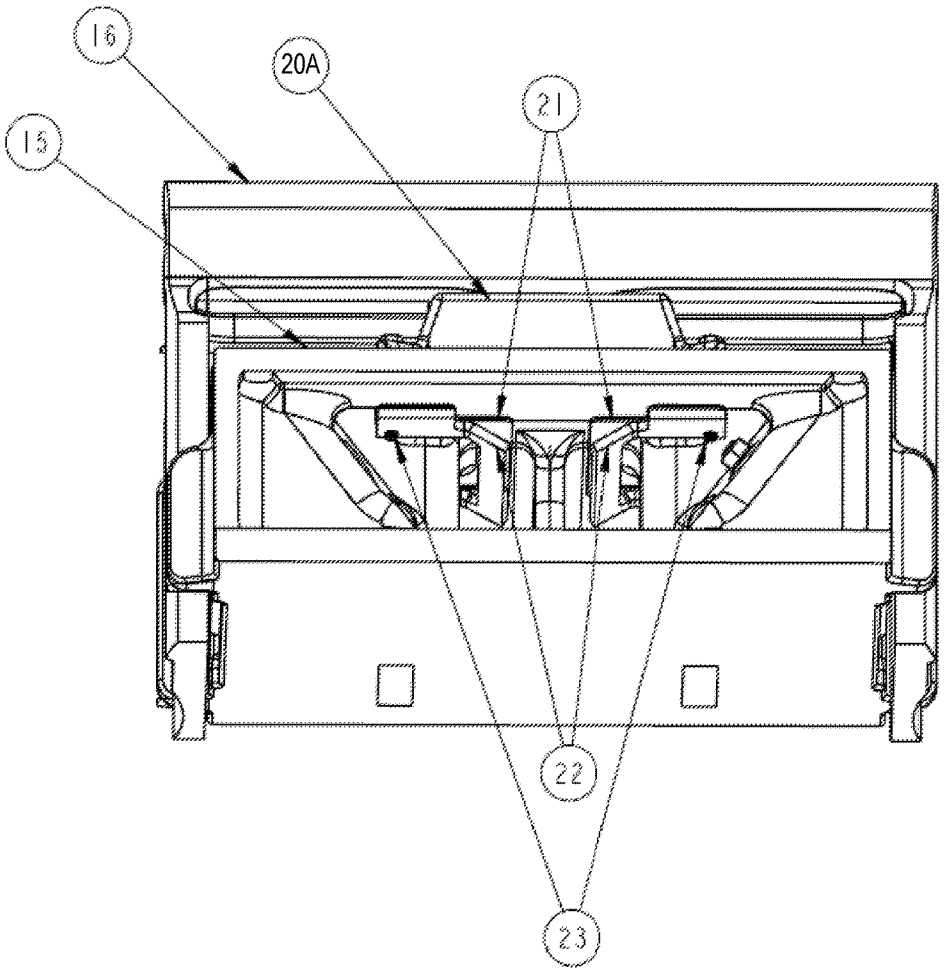
FIG. 5 is a partial detailed view of a traditional three piece railway freight truck with a second embodiment of the present invention.
Figure 6:
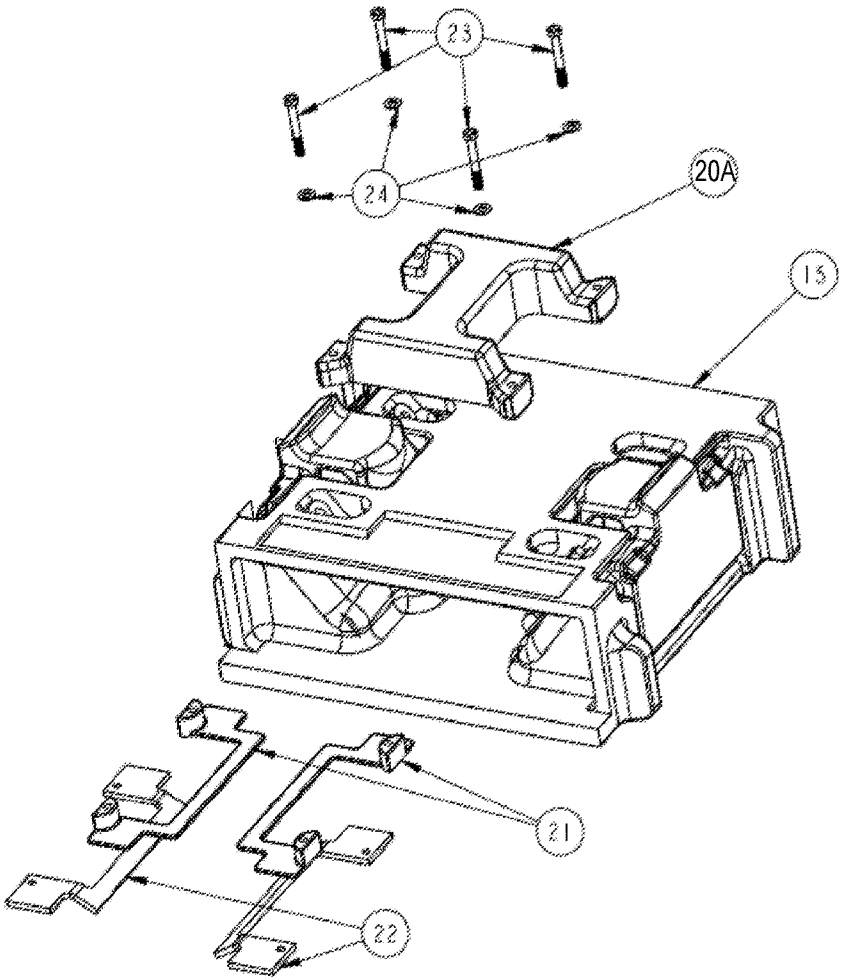
FIG. 6 is an exploded view of a second embodiment of the present invention.
Figure 7:
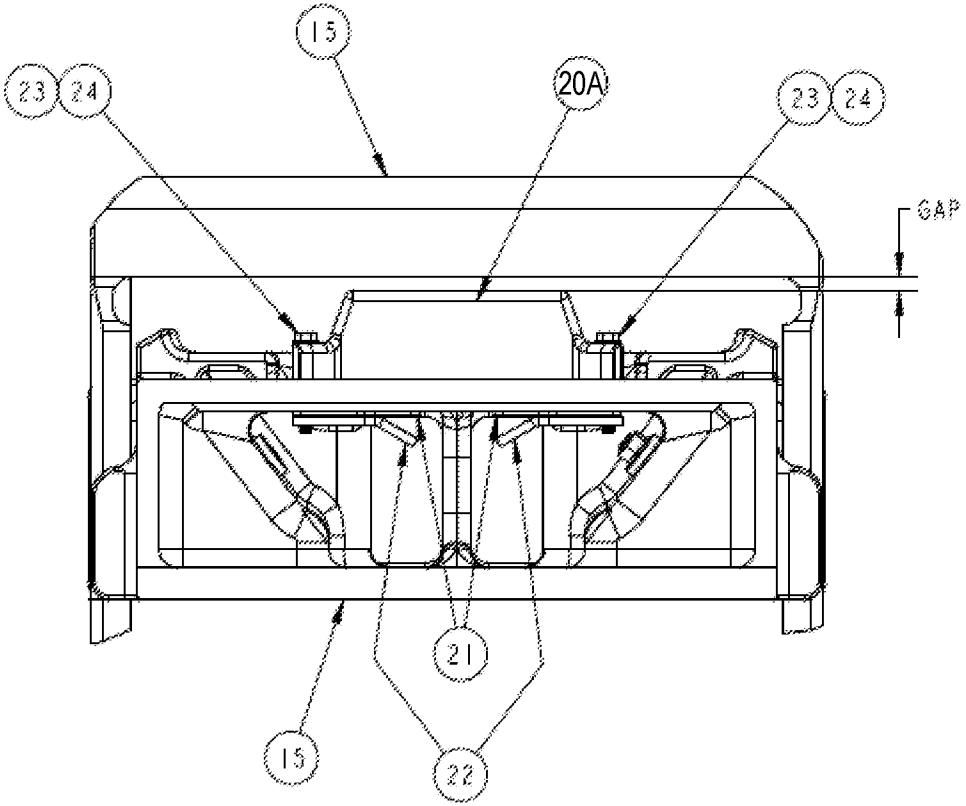
FIG. 7 is a partial assembly view of the gap between a second embodiment of the present invention and the railway truck side frame top center section.

Referring now to FIG. 1, is a perspective view of a three piece railway freight car truck assembly 1 is seen to be comprised of two laterally spaced side frames 2 and 13 between which bolster 3 extends. Bolster 3 is seen to include bolster ends 14 and 15, which extend through side frames 2 and 13. Suspension springs 10, are seen to support bolster ends 14 and 15. Under an empty railway freight car there is a space between the top of the bolster end 14 and 15 and the top center section of the side frame 16. It should be understood that railway freight car truck assembly 1 as shown in FIG. 1 can accommodate the vertical travel bumper 17 as seen in FIGS. 2, 3, and 4, with the introduction of holes in the top of the bolster end can accommodate vertical travel bumper 20A as seen in FIGS. 5, 6, and 7. Bolster 3 is seen to include on its upper surface a bolster center bowl 12, and a pair of laterally spaced side bearings 4. Wheelset 5 consists of two wheels 6 pressed on axle 7. The wheelset 5 has bearings 8 mounted at both ends of axle 7. The wheelset 5 bearings 8 support the side frames 2 and 13 on bearing adapters 9. Side frames 2 and 13 and bolster 3 are usually a single cast steel structure. Axle 7 is usually forged steel. Wheels 6 are usually cast steel.

Referring now to FIG. 2, is a partial detailed cut away view of a three piece railway freight car truck assembly 1. The top center section of side frame 2 is shown cut away to show a typical mounting arrangement for a first embodiment of the present invention to the top center section of the truck side frames.

Referring now to FIG. 3, is an exploded view of a first embodiment of the present invention and its typical mounting components. The bumper 17 is made from an energy absorbing elastomeric material. Its shape conforms with the underside of the side frame 2 top center section, straddling the center cross member, and has flanges that extend around the openings in the underside of the side frame top center section with holes for mounting fasteners. The spacer 18 is made of similar elastomeric material as the bumper. It also straddles the center cross member in the bottom of the side frame top center section and has flanges that extend around the openings with holes for the mounting fasteners. The nut plate 19 is made of steel and has threaded holes for the mounting fasteners. The mounting bolts 20 and washers 21 are industry standard parts. The bolts should have thread lock applied to prevent loosening in the field.

Referring now to FIG. 4, is a view of the space that is left between the bumper 17 and top of the bolster end 15. Normally this gap is expected to be between 7 and 13 mm (approximately 0.25 to 0.5 inch), the thickness of the bumper should be designed for each application such that the top of the bolster end only comes in contact with the bumper under extreme vertical displacements.

Referring now to FIG. 5, is a partial detailed cut away view of a three piece railway freight car truck assembly 1 with a second embodiment of the present invention mounted to the top of the bolster end.

Referring now to FIG. 6, is an exploded view of a second embodiment of the present invention and its typical mounting components. The bumper 20A is made from an energy absorbing elastomeric material. Its shape conforms to the underside of the side frame top center section and has flanges that extend around the openings in the top side of the bolster end with holes for mounting fasteners. The spacers 21 are made of similar elastomeric material as the bumper. They straddle the center rib that is typically found in the bolster end. The spacers also have flanges that extend around the openings in the top of the bolster end and have holes for the mounting fasteners. The nut plates 22 are made of steel and have threaded holes for the mounting fasteners. The mounting bolts 23 and washers 24 are industry standard parts. The bolts should have thread lock applied to prevent loosening in the field. Friction shoe 26 includes a vertical face 28. Bolster 15 includes two sloped surfaces 30 and 32.

Referring now to FIG. 7, is a view of the space that is left between the bumper 17 and the bottom of the side frame top section to center section 16. Normally this gap is expected to be between 7 and 13 mm (approximately 0.25 to 0.5 inch), the thickness of the bumper should be designed for each application such that the top of the bolster end only comes in contact with the bumper under extreme vertical displacements.

The invention claimed is:

1. A railway freight car truck comprising:

two side frames, each having a spring support base and a top center section, the top center section of each side frame having a bottom, bolster support springs on the side frame spring support base, a bolster extending traverse to the two side frames, the bolster having two end sections, each end section having a top and a bottom, each bolster end section extending into and being supported on one of the spring support bases by the support springs, each side frame including a bolster opening formed by two side frame vertical sidewalls, each bolster end section including two sloped surfaces, a friction shoe having a vertical face, an energy absorbing elastomeric bumper between the top of the bolster end and the bottom of the top center section of the side frames, at least a portion of the elastomeric bumper being positioned within the bolster opening of the side frame.

2. The railway freight car truck of claim 1 further comprising attaching plates with holes that allow the energy absorbing elastomeric bumper to be readily installed or removed.

3. The railway freight car truck of claim 2 further comprising a gap between the bumper and the side frame top center section, the gap sized to allow the truck suspension to operate normally but allow the bumper to absorb excess inertia energy before impact can occur between the side frame and bolster or bolster and brake equipment.

4. A railway freight car truck comprising:

two side frame, each having a spring support base and a top center section, the top center section of each side frame having a top and a bottom, bolster support springs on the side frame spring support base, a bolster extending traverse to the two side frames, the bolster having two end sections, each end section having a top and a bottom, each bolster end section extending into and being supported on one of the spring support bases by the support springs, each side frame including a bolster opening formed by two side frame vertical sidewalls, each bolster end section including two sloped surfaces, a friction shoe having a vertical face, an energy absorbing elastomeric bumper between the top of the bolster end and the bottom of the top center section of the side frames, at least a portion of the elastomeric bumper being positioned within the bolster opening of the side frames.

5. The railway freight car truck of claim 4 further comprising attaching plates with holes that allow the energy absorbing elastomeric bumper to be readily installed or removed.

6. The railway freight car truck of claim 5 further comprising a gap between the bumper and the top of the bolster end, the gap sized to allow the truck suspension to operate normally but allow the bumper to absorb excess inertia energy before impact can occur between the side frame and bolster.

* * * * *